United States Patent [19]

Yamamoto et al.

[11] 4,027,636

[45] June 7, 1977

[54] FLOW RATE CONTROL APPARATUS IN EXHAUST GAS RECIRCULATION SYSTEM

[75] Inventors: Tadahiro Yamamoto, Yokosuka; Kenji Yoneda, Yokohama, both of Japan

[73] Assignee: Nissan Motor Co., Ltd., Yokohama, Japan

[22] Filed: May 14, 1976

[21] Appl. No.: 686,533

[30] Foreign Application Priority Data

May 26, 1975 Japan ..... 50-62648

[52] U.S. Cl. ..... 123/119 A

[51] Int. Cl.² ..... F02M 25/06

[58] Field of Search ..... 137/119 A

[56] References Cited

UNITED STATES PATENTS 3,237,615 3/1966 Daigh ..... 123/119 A 3,465,736 9/1969 Daigh ..... 123/119 A 3,675,633 7/1972 Nakajima ..... 123/119 A

*Primary Examiner*—Robert G. Nilson

[57] ABSTRACT

A sonic nozzle is formed in a recirculation passage interconnecting the exhaust line to the induction passage of an internal combustion engine and a valve member is arranged to vary the throat area of the nozzle, while the induction passage has a similar combination of sonic nozzle and a valve member. The control apparatus has a valve actuating mechanism arranged to link the respective valve members in the sonic nozzles with a common element which is necessarily moved when a change in the engine speed is intended, so that the throat area in the recirculation passage is varied always in direct relation to the throat area in the induction passage.

8 Claims, 2 Drawing Figures

FLOW RATE CONTROL APPARATUS IN EXHAUST GAS RECIRCULATION SYSTEM

Figure 1:
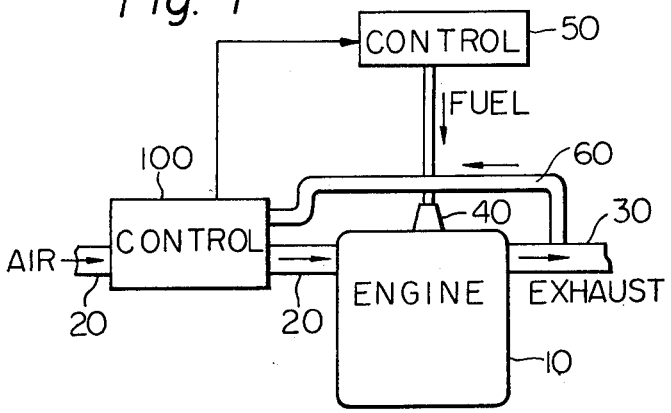

This invention relates to an exhaust gas recirculation circuit in an internal combustion engine, and more particularly to a flow control apparatus for controlling the quantity of the recirculated exhaust gas in direct relation to the quantity of air drawn into the engine.

It is a well known and practicable measure against formation of NO*x* in the operation of internal combustion engines, especially automotive engines, to recirculate a portion of the exhaust gas from the exhaust line to the intake system of the engine. An exhaust gas recirculation circuit for this purpose consists essentially of a recirculation passage which branches from the exhaust line and terminates at a certain section of the induction passage or an intake manifold and a flow control means for accomplishing the exhaust recirculation at an optimum recirculation rate, i.e. quantitative ratio of the recirculated exhaust gas to air drawn into the engine.

In conventional exhaust recirculation circuits, the recirculation rate is controlled by means of a flow control valve which can vary the cross-sectional area of the recirculation passage at a definite section. Because of difficulty in directly and continually detecting the quantity or mass flow rate of air drawn into the engine, the magnitude of vacuum created at the venturi section in a carburetor is utilized as a control signal representing the mass flow rate of air for the operation of the control valve. As a matter of inconvenience, the magnitude of the venturi vacuum is very small. There is a need, therefore, for the provision of a vacuum amplification means in order to operate the control valve in response to the vacuum signal. Alternatively, a valve actuator for the control valve needs to comprise a diaphragm of quite a large area.

Conventional apparatus for controlling the exhaust recirculation rate naturally suffer from their complicated construction and expenxiveness. Simplification of the apparatus has been tried but without success unless accuracy of the control is sacrificed to an intorerable extent. As is known, the performance of the engine is significantly deteriorated if the exhaust recirculation is carried out at an unstable and/or inaccurately controlled recirculation rate.

With respect to an internal combustion engine, it is an object of the present invention to provide a control apparatus for controlling the exhaust recirculation rate, which apparatus is simple in construction and can control the mass flow rate of the exhaust gas in a recirculation passage in direct and accurate relation to a variable flow rate of air in the induction passage of the engine.

An exhaust gas recirculation control apparatus according to the invention comprises: (a) a first venturi section formed in the induction passage of the engine to serve as a sonic nozzle; (b) a first valve member movably arranged in association with the first venturi section such that the effective throat area of the first venturi section is varied depending on the position of the first valve member, (c) a second venturi section formed in the exhaust gas recirculation passage to serve as a sonic nozzle, (d) a second valve member movably arranged in the second venturi section such that the effective throat area of the second venturi section is varied depending on the position of the second valve member, and (e) first valve actuating means for moving the first valve member in order to vary the flow rate of air through the first venturi section and change the speed of the engine, wherein the first valve actuating means include a movable member the movement of which causes the movement of the first valve member. As an essential feature of the invention, the apparatus further comprises a second valve actuating means which can transmit the movement of the aforementioned moveable member of the first valve actuating means to the second valve member such that the second valve member moves simultaneously with the first valve member and varies the effective throat area of the second venturi section in a predetermined relation to the variation in the effective throat area of the first venturi section.

Accordingly, the mass flow rate of the exhaust gas through the recirculation passage is varied always simultaneously with the occurrence of a variation in the mass flow rate of air through the induction passage regardless of the operational condition of the engine.

The first valve actuating means are preferably embodied as a combination of a rotatable shaft which is linked with a manipulation element exemplified by an accelerator pedal and a cam member which is fixedly mounted on the shaft and kept in contact with an extended end of the first valve member, and the second valve actuating means are embodied as another cam member which also is fixedly mounted on the same shaft and kept in contact with an extended end of the second valve member.

The control apparatus may include a detector such as a potentiometer for regulating the fuel feed rate to the engine in dependence on the position of the first valve member.

Figure 2:
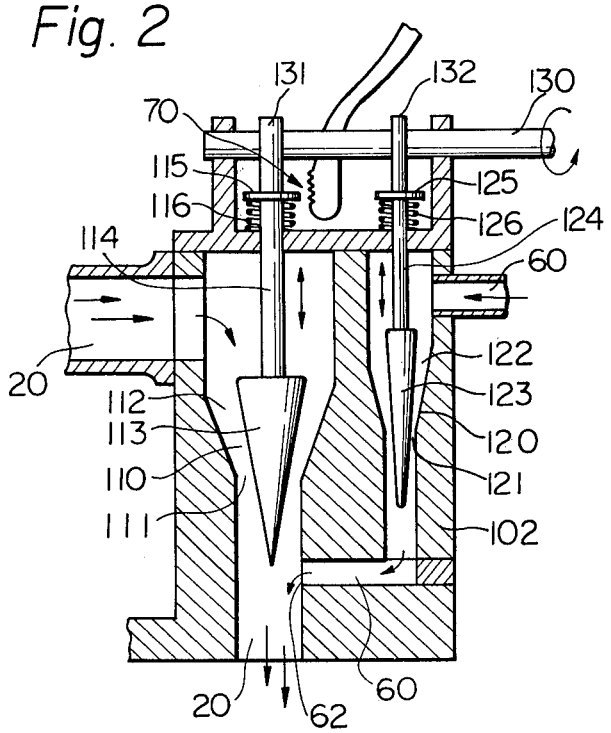

The invention will fully be understood from the following detailed description of a preferred embodiment with reference to the accompanying drawing, wherein:

FIG. 1 is a diagram showing a general arrangement of an exhaust gas recirculation circuit in an internal combustion engine including a control apparatus according to the invention; and FIG. 2 is an elevational view, partly in section, of a control apparatus as a preferred embodiment of the invention.

In FIG. 1, a conventional internal combustion engine 10 has an induction passage 20 and an exhaust pipe 30 in the usual manner. This engine 10 includes a fuel injector 40 for supplying fuel to the combustion chamber (not shown) of the engine 10 and a controller 50 which controls the fuel feed rate from the injector 40 in dependence on the quantity of air drawn into the combustion chamber as will be described hereinafter. An exhaust gas recirculation passage 60 is arranged to interconnect the exhaust pipe 30 to the induction passage 20 via a recirculation control apparatus 100 according to the invention. The induction passage 20 also is arranged to pass through this control apparatus 100.

FIG. 2 shows the construction of the control apparatus 100 in the exhaust recirculation circuit of FIG. 1. In this embodiment, two fluid passages are formed in a housing 102 of the control apparatus 100 respectively as a part of the induction passage 20 and a part of the exhaust recirculation passage 60. The exhaust recirculation passage 60 terminates and joins the induction passage 20 at a port or joint indicated at 62 within the housing 102. However, the joint between the induction passage 20 and the recirculation passage 60 may be formed outside of the control apparatus 100, and the control apparatus 100 may comprise two separate housings for respectively passing the two passages 20 and 60 therethrough.

The interior of the housing 102 is shaped such that the induction passage 20 has a venturi section 110 which takes the form of a sonic nozzle at a section within the housing 102. As is known, the sonic nozzle 110 includes a throat 111 and a converging section 112 formed conjoining to and upstream of the throat 111. A gas flow attains the velocity of sound at the throat 111 of this nozzle 110 when the pressure difference between the entrance and exit of this nozzle 110 is greater than a critical magnitude. A needle valve 113 is disposed in the induction passage 20 such that the needle valve 113 is arranged coaxially with the sonic nozzle 110 and can move in the axial directions of the nozzle 100 across the throat area 111. Accordingly, the effective cross-sectional area of the throat 111 is variable depending on the position of the needle valve 113. In this embodiment, the base (thickest section) of the needle valve 113 is located upstream of the throat 111. A stem 114 extends from the base of this valve 113 out of the housing 102, and a compression spring 116 is arranged between a flange 115 of the stem 114 and an outer surface of the housing 102 to bias the needle valve 113 in a direction (upwards in FIG. 2) to enlarge the effective cross-sectional area of the throat 111.

The exhaust recirculation passage 60 also takes the form of a sonic nozzle 120 at a section within the housing 102. The throat and converging section of this nozzle 120 are indicated at 121 and 122, respectively. A needle valve 123 is disposed in the recirculation passage 60 in the same manner as the valve 113 in the induction passage 20 to vary the effective cross-sectional area of the throat 121 of the nozzle 120.

A stem 124 extends from the base of this needle valve 123 in the same manner as the stem 114, and a compression spring 126 is arranged outside of the recirculation passage 60 to push a flange 125 of the stem 124 upwards.

The control apparatus 100 has a cam shaft 130 which can be turned on its axis by the manipulation of a pedal or a lever (not shown) for controlling the revolution of the engine 10. Two cam members 131 and 132 are fixedly mounted on the cam shaft 130, and the cam surfaces of these cams 131 and 132 are in contact with the two valve stems 114 and 116, respectively. The cams 131 and 132 are shaped such that the upward and downward movements of the two valves 110 and 120 to respectively vary the effective cross-sectional area of the throats 111 and 112 are caused simultaneously and in the same direction by the revolution of the cam shaft 130.

A potentiometer (variable resistor) indicated at 70 is arranged in association with this control apparatus 100 to detect the position of either the valve 110 or the cam 131 and supply a signal representing the detected position to the fuel injection control apparatus 50.

The function of the thus constructed control apparatus 100 may already have been understood. The cam shaft 130 revolves when, for example, an accelerator pedal (not shown) for the control of the engine 10 is manipulated in accordance with the travel of the pedal so that the two cams 131 and 132 rotate simultaneously. As the result, the two valves 113 and 123 are pulled up, for example, simultaneously and the effective cross-sectional areas of the throats 111 and 121 of the sonic nozzles 110 and 120 are enlarged simultaneously. If the flows of air and the recirculated exhaust gas have attained the sonic velocity respectively at the throats 111 and 121 of the nozzles 110 and 120 (these nozzles 110 and 120 are designed to realize sonic flows of air and exhaust gas except when the engine 10 is run at very low speeds), the mass flow rates of air and the recirculated exhaust gas vary respectively in exact proportion to the effective cross-sectional areas of the nozzles 110 and 120 at their throats 111 and 121.

The quantity of air drawn into the engine 10 is varied depending on the position of the needle valve 113, and the fuel feed rate to the engine 10 is regulated by the controller 50 according to the flow rate of air through the nozzle 110 detected by the potentiometer 70. At the same time, the flow rate of the recirculated exhaust gas through the nozzle 120 is regulated by the movement of the needle valve 120. Since the cams 131 and 132 for respectively moving the valves 113 and 123 are mounted on the same cam shaft 130, the effective cross-sectional area of the nozzle 120 for the exhaust recirculation at the throat 121 can be varied always in direct and desired relation to the effective cross-sectional area of the air nozzle 110 at its throat 111. The relationship between the effective cross-sectional areas of the two throats 111 and 121, i.e., the exhaust recirculation rate, can be determined optionally (e.g., to be constant) by the design of the two cams 131 and 132.

As seen from the foregoing description, a part of the control apparatus 100 represented by the sonic nozzle 110 and the needle valve 113 constitutes a metering device in the induction passage 20.

The dependence of the flow rate of the recirculated exhaust gas through the nozzle 120 on the flow rate of air in the nozzle 110 can always be maintained as intended even if the operational condition of the engine 10 is widely variable as in the case of automotive engines. The dependence can be maintained, although small errors might accompany, even when the engine 10 is operated at such a low speed that the flows of air and exhaust gas are subsonic at the throats 111 and 121, because the same exit pressure, i.e. intake vacuum, is imposed upon the two nozzles 110 and 120 (the realization of a sonic flow in each of the nozzle 110 and 120 is governed by the exit pressure because of small magnitudes of the entrance pressures). Consequently, the formation of NOx can effectively be suppressed almost over the entire range of the operational condition of the engine 10. The control apparatus 100 is advantageous also from the manufacturing and economical viewpoints since the apparatus 100 needs no vacuum device for moving the valve member 123 and employs a very simple mechanism.

It will be understood that the needle valves 113 and 123 are not necessarily be moved by means of the cams 131 and 132 but may alternatively be moved by a valve-lifting mechanism of a different type such as, e.g., a mechanical linkage. It is a sole requisite to the valve-lifting mechanism that the two valves 113 and 123 can be moved simultaneously by the movement of a single element as represented in FIG. 2 by the cam shaft 130. The invention is applicable to an engine which is equipped with a carburetor in place of the illustrated fuel injection system. In this case, the throat area of the recirculation nozzle 120 is varied simultaneously with and in direct relation to a variation in the throat area of a sonic nozzle (110) which controls the quantity of air drawn into the engine and functions also as a throttle valve in the carburetor, and at the same time the effective cross-sectional area of a fuel discharge passage in the carburetor is varied in dependence on the position of a needle-valve (113) in the air nozzle (110) through either a mechanical linkage or a hydraulic line.

What is claimed is:

1. In an interanl combustion engine having an exhaust gas recirculation passage which interconnects the exhaust line to the induction passage of the engine, apparatus for controlling the mass flow rate of the exhaust gas in the recirculation passage comprising:

a first venturi section formed in the induction passage to serve as a sonic nozzle;

a first valve member movably arranged in association with said first venturi section such that the effective cross-sectional area of said first venturi section is varied depending on the position of said first valve member;

a second venturi section formed in the exhaust gas recirculation passage to serve as a sonic nozzle;

a second valve member movably arranged in association with said second venturi section such that the effective cross-sectional area of said second venturi section is varied depending on the position of said second valve member;

first means for moving said first valve member to vary the flow rate of air through said first venturi section and vary the speed of the engine, said first means including a movable member the movement of which causes the movement of said first valve member;

second means for transmitting the movement of said movable member of said first means to said second valve member such that said second valve member moves simultaneously with said first valve member and varies the effective cross-sectional area of said second venturi section in a predetermined relation to the variation in the cross-sectional area of said first venturi section.

2. A flow control apparatus as claimed in claim 1, wherein said second valve member is a needle valve arranged to move axially of said second venturi section.

3. A flow control apparatus as claimed in claim 2, wherein said movable member is a shaft which is turnable on the axis thereof, said first means including a first cam member fixedly mounted on said shaft in such an arrangement that the position of said first valve member is varied according to the movement of said first cam member, said second means including a second cam member fixedly mounted on said shaft and arranged such that the position of said second valve member is varied according to the movement of said second cam member.

4. A flow control apparatus as claimed in claim 3, wherein said first valve member is a needle valve arranged to move axially of said first venturi section.

5. A flow control apparatus as claimed in claim 3, wherein said first and second means include first and second springs, respectively, arranged to keep said first and second valve members in contact with the cam surfaces of said first and second cam members, respectively.

6. A flow control apparatus as claimed in claim 3, wherein said shaft is linked with a member which is necessarily manipulated to change the speed of the engine.

7. A flow control apparatus as claimed in claim 1, further comprising third means for detecting a variation in the position of said first valve member and producing a signal representing the detected position for regulating the fuel feed rate to the engine in dependence on the position of said first valve member.

8. a flow control apparatus as claimed in claim 7, wherein said third means include a potentiometer arranged such that the resistance of said potentiometer varies in accordance with the movement of said first valve member.

* * * * *